US007413479B1

(12) United States Patent
Volpone

(10) Patent No.: US 7,413,479 B1
(45) Date of Patent: Aug. 19, 2008

(54) COVER LOCK

(75) Inventor: Thomas A. Volpone, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/707,292

(22) Filed: Feb. 16, 2007

(51) Int. Cl.
*H01R 13/46* (2006.01)

(52) U.S. Cl. ..... 439/692; 439/352; 220/326; 174/138 F

(58) Field of Classification Search ..... 439/352, 439/353, 731, 892; 220/326, 780–786, 794, 220/285, 4.02; 174/138
See application file for complete search history.

(56) References Cited

U.S. PATENT DOCUMENTS

| | | | | | |
|---|---|---|---|---|---|
| 3,629,803 | A * | 12/1971 | Gluntz | 439/330 |
| 4,212,415 | A * | 7/1980 | Neely | 222/231 |
| 4,484,791 | A * | 11/1984 | Johnson | 439/404 |
| 4,484,792 | A * | 11/1984 | Tengler et al. | 439/578 |
| 4,538,873 | A * | 9/1985 | Worth | 439/404 |
| 4,746,008 | A * | 5/1988 | Heverly et al. | 206/1.5 |
| 4,840,286 | A * | 6/1989 | Heberling et al. | 220/4.02 |
| 4,951,716 | A | 8/1990 | Tsunoda et al. | |
| 5,217,390 | A * | 6/1993 | Nozaki et al. | 439/489 |
| 5,577,779 | A * | 11/1996 | Dangel | 292/80 |
| 5,672,071 | A * | 9/1997 | Ceru | 439/353 |
| 5,931,514 | A * | 8/1999 | Chung | 292/89 |
| 6,126,123 | A | 10/2000 | Yang | |
| 6,179,643 | B1 * | 1/2001 | Fukuda | 439/358 |
| 6,328,355 | B1 * | 12/2001 | Bortz | 292/307 R |
| 6,398,594 | B1 * | 6/2002 | Bonilla et al. | 439/731 |
| 6,901,632 | B2 * | 6/2005 | Boyce | 16/231 |
| 6,967,286 | B2 | 11/2005 | Daito | |
| 2004/0137781 | A1 * | 7/2004 | Ye et al. | 439/404 |
| 2005/0145410 | A1 | 7/2005 | Daito | |

FOREIGN PATENT DOCUMENTS

| | | |
|---|---|---|
| JP | 06-86426 | 3/1994 |
| JP | 2000-253533 | 9/2000 |

* cited by examiner

*Primary Examiner*—Tulsidas C. Patel
*Assistant Examiner*—Harshad C Patel
(74) *Attorney, Agent, or Firm*—David P. Wood

(57) ABSTRACT

An electrical housing has a first member and a second member that can be locked and unlocked with a cover lock. The cover lock itself can include a male member disposed on one of the members, and a female member disposed on the other of the members for mating with the male member. A rib can also be provided on either the first or second member to help mate the male member with the female member.

15 Claims, 1 Drawing Sheet

COVER LOCK

FIELD OF THE INVENTION

This invention relates generally to electrical housings, and more particularly to, a cover lock for electrical housings.

BACKGROUND OF THE INVENTION

Electrical housings, such as protectors or wire channels, can be used to internally route and protect electrical wires and like components. These housings are commonly used in vehicles like automobiles. The electrical housings are ordinarily fitted with separate covers and cover locks that secure the covers on housing bodies. Some cover lock designs can be easily damaged when unlocked.

SUMMARY OF THE INVENTION

One embodiment of the invention can include a cover lock for an electrical housing having a male member disposed on a first member of the electrical housing to be mated with a female member disposed on a second member of the electrical housing for locking the first member to the second member. The male member has a pair of ramps that are spaced horizontally apart to define a vertical slot that is capable of receiving a tool for unlocking the cover lock.

Another embodiment of the invention can include an electrical housing having a body with a side wall, a cover with an edge that fits over the body, and at least one cover lock that secures the cover to the body. The cover lock further includes a male member extending from the cover's edge, a female member extending from the body's side wall, and at least one rib mounted on the body's side wall.

Another embodiment of the invention can include a method having the steps of providing a cover lock with a male member disposed on a first member of an electrical housing, and providing a female member disposed on a second member of the electrical housing. The method also has the steps of locking the first member to the second member by inserting the male member into the female member, and unlocking the first member from the second member by wedging a tool partly within both the male member and the female member to flex the male member and the female member away from each other.

DETAILED DESCRIPTION OF THE PREFERRED EMBODIMENTS

Figure 1:
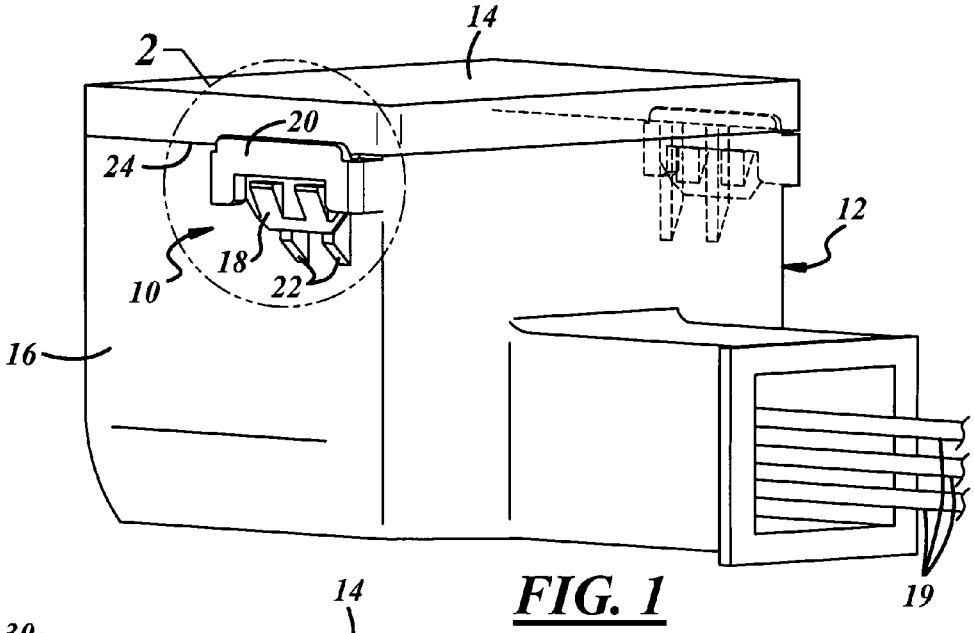
FIG. 1 is a perspective view showing an embodiment of an electrical housing having a cover lock of the invention.
Figure 3:
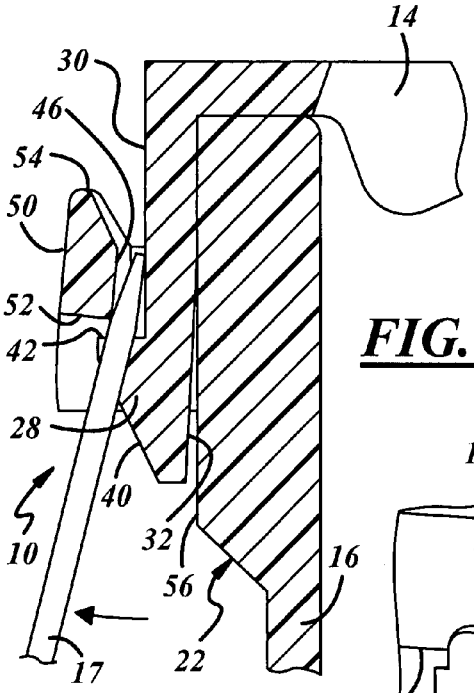
FIG. 3 is a sectional view taken substantially along line 3-3 of FIG. 2 looking in the direction of the arrows, and also showing a tool flexing a female member of the cover lock away from a male member of the cover lock.
Figure 2:
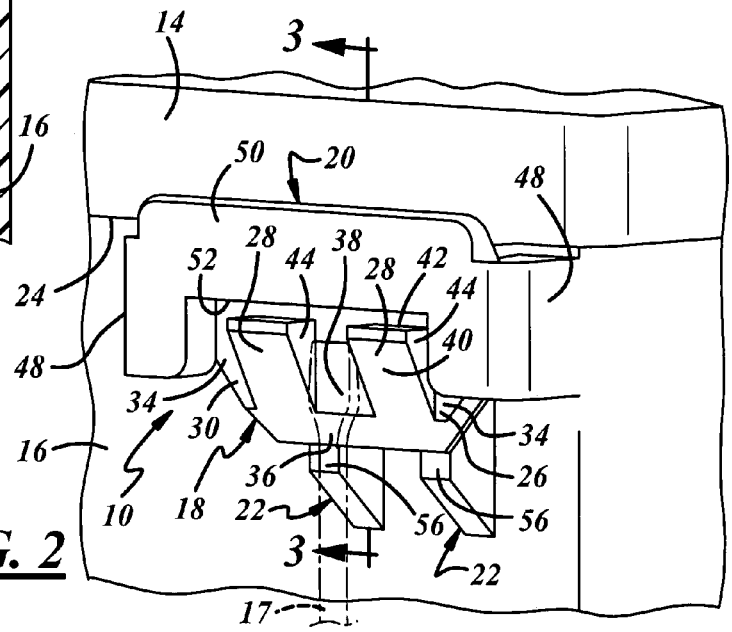
FIG. 2 is an enlarged view of the cover lock shown in FIG. 1.

Referring in more detail to the drawings, FIGS. 1-3 show a cover lock 10 that can be used to lock and unlock a first member, such as a cover 14, and a second member, such as a body 16, of an electrical housing 12. In particular, the cover lock 10 is constructed so that it can be unlocked with a tool, such as a screwdriver 17, without damaging the cover lock. The electrical housing 12 itself can be a protector, a wire channel, or the like, that has one or more of the cover locks 10 on one or more of its sides. The cover 14 fits over the body 16 which holds electrical components such as wires 19. The cover lock 10 includes a male member 18 that mates with a female member 20, and can optionally include a pair of ribs 22 to help ensure proper mating between the members.

Referring now to FIG. 2, the male member 18 mates in and out of the female member 20 to respectively lock and unlock the cover lock 10. The male member 18 is made out of a suitable plastic like the thermoplastic polypropylene, or the like. It is injection molded as part of the electrical housing 12, or it can be formed as a separate piece and later attached to the electrical housing 12 by welding, fastening, gluing, or the like. The male member 18 can be disposed on either the cover 14 or the body 16. Accordingly, and although shown extending from an edge 24 of the cover 14, the male member 18 could extend from an edge of the body 16.

Referring now to both FIGS. 2 and 3, the male member 18 has a body 26 that serves as the main structure of the male member 18. The body 26 can define a front surface 30 and a planar back surface 32. When mated, the front surface 30 faces the female member 20 and the back surface 32 faces the ribs 22. A pair of flanges 34 can extend laterally away from the body 26 to give the male member 18 a better fit and tighter hold when mated with the female member 20. The body 26 can also include a bevel 36 extending continuously along its edge from each flange 34 and therebetween, to again help mate the male member 18 with the female member 20.

A pair of ramps 28 is provided on the male member 18 for inserting the male member 18 into the female member 20, and to hold the male member therein. The pair of ramps 28 are two distinct ramps that are spaced horizontally apart to define a slot 38 that will be discussed later. And more than a pair of ramps 28 can be provided and still define the slot 38. In any case, each ramp can have a ramp-like shape or similar shapes to allow the male member 18 to be inserted in the female member 20. The ramps 28 protrude from the front surface 30 at an end of the body 26. Each ramp has a ramp surface 40 extending from the bevel 36 to a top surface 42. Each ramp also has at least one side surface 44 that partly defines the slot 38. As shown, each ramp 28 has two side surfaces 44 with only one of them defining part of the slot 38.

Referring now to FIGS. 2 and 3, the slot 38 can receive part of the screwdriver 17 for unlocking the cover lock 10. In other words, the screwdriver 17 can be placed through the slot 38 to wedge between the male member 18 and the female member 20 and to slightly pry the members away from each other by creating a fulcrum at or near the slot 38. In this sense, the slot 38 can be particularly sized to receive an end of the screwdriver. As shown, the slot 38 is flush with the front surface 30 and is planar on all sides. The slot 38 could also be indented partly into the front surface 30. The slot 38 is also shown horizontally centered on the body 26.

The female member 20 receives and releases the male member 18 to respectively lock and unlock the cover lock 10. Like the male member 18, the female member 20 is made out of a suitable plastic like the thermoplastic polypropylene, and is injection molded as part of the electrical housing 12 or formed as a separate piece to be later attached to the electrical housing 12 by welding, fastening, gluing, or the like. The female member 20 can be disposed on either the cover 14 or the body 16, whichever one is opposite the male member 18 in the particular case. As shown, the female member 20 extends from a side wall of the body 16. In order to receive and release the male member 18, the female member 20 defines a passage 46 by a pair of oppositely disposed legs 48 with a beam 50 extending therebetween.

The passage 46 extends completely through the female member 20, and is sized to receive the male member 18. On each side, the legs 48 protrude away from the side wall of the body 16 a sufficient distance to accommodate the ribs 22 and the mated male member 18. The beam 50, on the other hand, extends horizontally between the legs 48 and is slightly raised above them to define an offset or indentation 52 that catches the ramps 28 when the members are mated. The slight raise more evenly distributes stress on the female member 20. The beam 50 has an upper edge with a taper 54 to ease inserting the male member 18 into the female member 20 as will be described later.

As mentioned, the cover lock 10 can optionally include the ribs 22 for fitting the male member 18 with the female member 20 when they are mated. In other words, the ribs 22 can ensure that the ramps 28 are positioned properly to be caught by the indentation 52. The ribs 22 are made of a suitable plastic like the thermoplastic polypropylene, and are injection molded as part of the electrical housing 12 or formed as a separate piece to be later attached by welding, fastening, gluing, or the like. The ribs 22 are disposed on either the cover 14 or the body 16, depending on where the female and male members are located. As shown, the ribs 22 are located adjacent and underneath the female member 20 and protrude away from the side wall of the body 16 and extend from the top of the side wall down past the female member 20. In other embodiments, the ribs 22 could be a single rib similarly situated as the above described pair of ribs. In any case, the ribs 22 define a bearing surface 56 on its front face.

When used with the electrical housing 12 as shown in the figures, the cover lock 10 can selectively lock and unlock the cover 14 to and from the body 16. The cover 14 and the body 16 can be first aligned and brought together as shown in FIG. 1 where the cover 14 lies on top of the body 16. The lock assembly 10 can then be locked by snapping it into place, thus mating the male member 18 with the female member 20 on one side of the electrical housing 12, or on both sides simultaneously. Looking at just one side, while mating, the male member 18 slides over the ribs 22 so that the back surface 32 bears against the bearing surface 56. As the male member 18 is being inserted into the passage 46 this way, the ramp surface 40 approaches and contacts the taper 54 as the male member 18 continues through the passage 46 until the ramps 28 extend past the beam 50 and the top surface 42 is caught in the indentation 52. The cover lock 10 is now locked and the male member 18 is trapped between the female member 20 and the ribs 22.

To unlock the cover lock 10, the male member 18 is removed out of the passage 46 of the female member 20 without damaging either member. To do this, the screwdriver 17 is placed in the slot 38 and at least partly in the passage 46 from either the top direction or the bottom direction. From the top direction, the end of the screwdriver is first wedged through the passage 46 from the taper 54 side and can continue completely through the passage 46 and into the slot 38 to define a fulcrum at about the slot 38 at which to pivot the screwdriver end. The screwdriver end is then pivoted thereat to pry the beam 50 over the ramps 28. Both the beam 50 and the male member 18 flex away from each other so that the male member 18 can be pulled out of the female member 20 and thus the cover 14 can be taken off of the body 16. From the bottom direction, as shown in FIGS. 2 and 3, the screwdriver end is wedged first into the slot 38 and continues at least partly into the passage 46 to define a fulcrum at about the passage 46. The screwdriver end is pivoted and pried in the direction of the arrow in FIG. 3 to lift the beam 50 over the ramps 28. Both the beam 50 and the male member 18 similarly flex away from each other so that the male member 18 can be pulled out of the female member 20 and the cover 14 can be taken off of the body 16. Because the screwdriver 17 can use the slot 38 in either case to define a fulcrum at the slot 38 itself or at the passage 46, the beam 50 can be easily pried away from the male member 18, and vice versa, so that neither the male member 18 nor the female member 20 are damaged.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

I claim:

1. A cover lock for an electrical housing, comprising:

an external male member disposed on a first member of the electrical housing and having at least a pair of ramps spaced horizontally apart to define a vertical slot defined in part by an imperforate front surface of the external male member that extends between a first ramp and a second ramp of the at least pair of ramps, the vertical slot being capable of receiving a tool for unlocking the cover lock; and an external female member disposed on a second member of the electrical housing and that mates with the male member for locking the first member to the second member, the female member projecting outwardly of the second member and defining a passage between the female member and the imperforate front surface of the male member when the female member mates with the male member, the passage being capable of receiving the tool that is received in the vertical slot between the first ramp and the second ramp.

2. The cover lock of claim 1 further comprising at least one external rib disposed on the second member of the electrical housing adjacent the female member for fitting underneath the male member when the two are mated.

3. The cover lock of claim 1 wherein the vertical slot is defined by a side wall of the first ramp and a side wall of the second ramp.

4. The cover lock of claim 1 wherein the female member has a pair of oppositely disposed legs projecting away from the second member of the electrical housing with a beam extending therebetween, the beam having a tapered edge, and the pair of legs and the beam defining the passage such that when the male member mates with the female member, the at least pair of ramps bear against the tapered edge as the male member is inserted in the passage.

5. The cover lock of claim 2 wherein the male member is trapped between the female member and the at least one rib where a front surface of the male member bears partly against the female member, and a back surface of the male member bears partly against the at least one rib when the male member is mated with the female member.

6. An electrical housing, comprising:

a body that holds electrical components and that has a side wall;

a cover that fits over the body and that has an edge; and at least one cover lock that secures the cover to the body, the cover lock comprising:

an external male member extending from the edge of the cover;

an external female member that extends outwardly from the side wall of the body and that mates with the male member for locking the cover to the body; and at least one rib mounted on the side wall of the body adjacent the female member so that the male member bears against the at least one rib to space the male member from the side wall of the body when the male member mates with the female member, and wherein the male member has a body having a pair of ramps that extend outwardly from the body, the pair of ramps being spaced apart horizontally so that a side wall on each of the pair of ramps defines a vertical slot of the male member, the vertical slot being defined in part by an imperforate front surface of the male member that extends between a first ramp and a second ramp of the at least pair of ramps and that is capable of receiving a tool for engaging the imperforate front surface of the male member as a fulcrum for prying the external male member and the external female member away from each for unlocking the cover from the body, and the body and the cover defining a passage between the female member and the imperforate front surface of the male member when the female member mates with the male member, the passage being capable of receiving the tool that is received in the vertical slot.

7. The electrical housing of claim 6 wherein the at least one cover lock is disposed on one side of the electrical housing, and a second identical cover lock is disposed on an opposite side of the electrical housing.

8. The electrical housing of claim 7 wherein each female member of each cover lock comprises a pair of legs protruding from the side wall and a beam extending therebetween, the pair of legs and the beam defining a passage for inserting the male member when locking the cover to the body.

9. The electrical housing of claim 7 wherein each cover lock has a pair of ribs mounted on the side wall of the body, each rib having a bearing surface such that the male member partly bears against each bearing surface when the male member is mated with the female member.

10. The electrical housing of claim 6 wherein the male member is trapped on one side by the female member and on an opposite side by the at least one rib when the male member is mated with the female member.

11. A method of selectively locking and unlocking a first member and a second member of an electrical housing, the method comprising the steps of:

providing a cover lock having an external male member disposed on the first member and an external female member disposed on the second member, the male member having at least a pair of ramps spaced horizontally apart to define a vertical slot defined in part by an imperforate surface of the male member that extends between a first ramp and a second ramp of the at least pair of ramps, the female member defining a passage between the female member and the imperforate front surface of the male member when the male member mates with the female member;

locking the first member to the second member by inserting the at least one pair of ramps of the male member into the passage of the female member; and unlocking the first member from the second member by wedging a tool partly within the slot of the male member and partly within the passage of the female member, engaging the imperforate surface of the male member, and prying the male member and the female member away from each other so that the male member can be removed out of the female member.

12. The method set forth in claim 11 wherein at least one rib is disposed on the second member adjacent the female member for fitting the male member with the female member when the male member is inserted into the female member.

13. The method set forth in claim 11 wherein the male member has a front surface with the slot being horizontally centered on the front surface between a first ramp and a second ramp of the at least pair of ramps with a side surface of each ramp defining a respective side of the slot.

14. The method set forth in claim 11 wherein the passage of the female member is defined by a pair of oppositely disposed legs that protrude away from the second member and a beam extending therebetween.

15. The electrical housing of claim 1 wherein the external male member has a body and the pair of ramps extend outwardly from the body, the pair of ramps being spaced apart horizontally so that a side wall on each of the pair of ramps defines the vertical slot of the male member that is capable of receiving the tool for engaging the imperforate front surface of the male member as a fulcrum for prying the external male member and the external female member away from each for unlocking the cover from the body.

* * * * *